United States Patent [19]

Verhoeven

[11] 4,383,724

[45] May 17, 1983

[54] BRIDGE CONNECTOR FOR ELECTRICALLY CONNECTING TWO PINS

[75] Inventor: Laurentius M. Verhoeven, Zijtaart, Netherlands

[73] Assignee: E. I. Du Pont de Nemours and Company, Wilmington, Del.

[21] Appl. No.: 252,880

[22] Filed: Apr. 10, 1981

[30] Foreign Application Priority Data

Jun. 3, 1980 [NL] Netherlands ..... 8003228

[51] Int. Cl.[3] ..... H01R 31/08

[52] U.S. Cl. ..... 339/19; 339/258 R

[58] Field of Search ..... 339/18, 19, 222, 258 R, 339/258 F, 258 P

[56] References Cited

U.S. PATENT DOCUMENTS 3,868,163 2/1975 Jarosek ..... 339/19

3,876,274 4/1975 Ruehlemann et al. ..... 339/258 R 3,902,778 9/1975 Wyshak et al. ..... 339/19

FOREIGN PATENT DOCUMENTS 2212983 7/1974 France .

7300894 8/1973 Netherlands .

973983 11/1964 United Kingdom ..... 339/18 R

OTHER PUBLICATIONS

Electronics International, vol. 48, No. 8, 4-17-1975, pp. 156-159.

IBM Bulletin, Cioffi, vol. 8, No. 10, p. 1327, 3-1966.

*Primary Examiner*—Neil Abrams

[57] ABSTRACT

Jumper connector for multiple parallel pins. This connector has a central leg and one pair of branched contacts on each side. Each pair of branched contacts engage a pin from a printed circuit board.

10 Claims, 10 Drawing Figures

Fig. 2
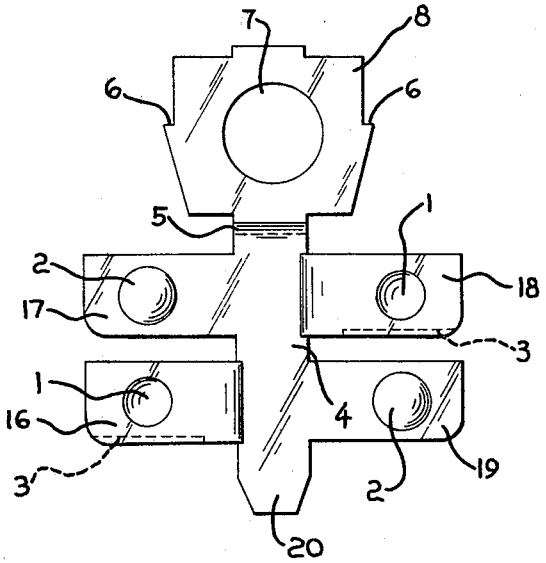
Fig. 3
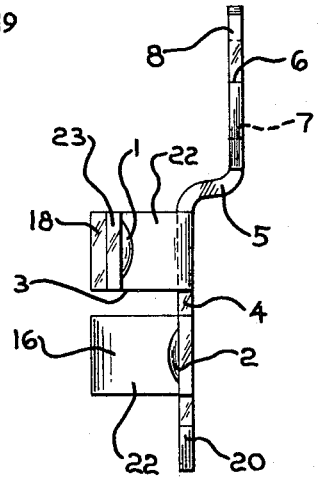
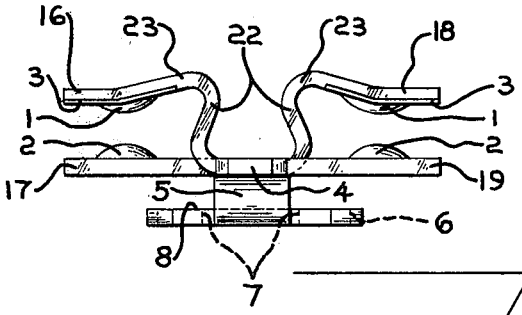
Fig. 4

BRIDGE CONNECTOR FOR ELECTRICALLY CONNECTING TWO PINS

BACKGROUND OF THE INVENTION

The invention relates to a bridge connector for electrically connecting mainly parallel pins, for instance, the connector pins mounted on a printed circuit board.

Conventional methods to connect such pins entail the use of a bridge or jumper contact which can be slid over the two pins to be connected. Generally the location of this bridge contact is such that it extends above the top of said pins. The disadvantage inherent in the earlier method of interconnection lies in the lack of space available above the pin ends, and particularly, in the inaccessibility for subsequent connection of said pins by a plurality of bridges to adjacently located pins on the printed circuit board. The latter can cause a problem especially in applications where it is necessary to mutually connect a number of pins for obtaining a desired or programmed electrical interconnection.

SUMMARY OF THE INVENTION

The above disadvantages can be overcome by utilizing an electrical bridge connector described in the present invention. This bridge connector is characterized by a central leg of resilient material integrally formed with at least a pair of branch contacts located at either side of the central leg. Each pair of branch contacts comprise:

(a) an essentially flat section lying in the plane of the central leg and (b) a bent or raised section above the plane of the central leg, extending in a straight line.

The level of the central leg and the flat section of branch contact is defined as the first level, while the straight portion of the bent section is the second level. The two corresponding planes are considered to be essentially parallel to each other. For such a pair of branch contacts, the ends of the flat section and that of the bent section extend for equal distances from and transverse to the central leg. Furthermore, the bent section of the first pair of branch contacts is diagonally opposite the flat section of the second pair of branched contacts, each being adjoined transversely to the central leg at the said first level.

When such a bridge contact is slid on two adjacent pins, each pin is gripped and held by a pair of branch contacts between the flat section in the first level, and the straight portion of the bent section in the second level. Since the bent section of each branch contact pair is not diagonally opposite to each other but are staggered along the length direction of the central leg, opposing torsional moments are exerted on the two pins being connected.

This bridge contact is inserted into, an essentially, hollow housing with an opening at the top. The two inner side walls of this housing have appropriate parallel channels to receive the free ends of branch contacts during the insertion of the bridge connector into the housing.

The bridge connector comprising the bridge contact assembled in the housing will preferably be of such dimensions that once the first bridge connector has been connected to two pins and is flush with a printed circuit board, at least a second bridge connector can be stacked above the first to enable interconnection of a third pin adjacent to the initial two pins contacted in the printed circuit board. This method can be conveniently used to mutually connect a number of pins according to a predetermined circuit interconnection. A primary advantage of this bridge connector is that the bridge contact is located in the space between adjacent pins, an area which otherwise would be redundant and not be utilized. This feature is particularly suitable to facilitate optimum space utilization in packaging systems with a high population density of pins on the printed circuit board. Provided that the bridge connectors of this invention are sufficiently small and there is adequate pin length, the free protruding pin ends can be freely utilized for subsequent interconnection to other pins.

As a matter of fact these bridge connectors can be utilized in conjunction with printed circuit boards of various designs.

Furthermore the use of these bridge connectors is not limited only to the interconnection of pins mounted in printed circuit boards. Neither are the dimensions of the bridge connector restricted to those complying with the space available between pins on the printed circuit board.

As explained earlier, once the bridge connector is mounted over two pins, opposing torsional moments are generated by each pair of branch contacts contacting the two pins. Thus the resultant force exerted finally on the central leg is insignificant. This feature is useful to compensate for possible mutual deviations in an array of pins in any localized area in the printed circuit board. Typical contributors to these deviations are:

(a) skew of pin;

(b) nonparallelism of the faces of square pins;

(c) variation in pin cross-sectional dimensions;

(d) tolerance deviations in the position of holes, and hence pins, on the printed circuit board.

When the bridge contact is assembled in the housing, the free end of each branch contact is located in the corresponding housing channel, separated by an interposing ridge. These free ends are then supported on the sides of a ridge to give a preloaded condition which is beneficial towards:

(a) a reduction of insertion force of the pin entering each branch contact;

(b) facilitating a proper centering of the bridge contact with respect to the lead in holes for pins, such that these pins can be introduced easily into the connector.

Preferably the central leg comprises an elongation at one end consisting of a neck portion and a shoulder portion. The neck portion is bent perpendicularly to the plane of the central leg, while a boradened shoulder portion at the end of the neck portion is parallel to the previously mentioned first and second levels. The edges of the broadened shoulder portion are received in two opposing channels in the housing which are parallel to the central leg of the bridge contact. Preferably these channels, are located in the open portion of the housing side wall perpendicular to the said levels.

Preferably barbs are provided at the sides of the shoulder portion. Hence when the bridge contact is inserted into the enclosure, these barbs dig into the plastic material of the appropriate housing channel. The shoulder portion has a hole in which an electrical test probe can be anchored.

The free ends of the branch contact have a localized sectional profile shaped to facilitate easy entry of the pin. Such local profiles may be spherical or cylindrical in shape depending on sectional profile and shape of the pin to be used. These pins may have a rectangular, round or even an oval cross section. Appropriate choice of the local sectional profile of the branch contact will be made to allow the most suitable electrical connection and contacting means.

At the inner bottom surface is located a cavity. This receives the elongated portion of the central leg opposite to the shoulder portion. This further enhances the stability and locking of the bridge contact in the housing.

Instead of having one housing for each bridge contact, a plurality of bridge contacts can be assembled longitudinally adjacent or side-by-side in an appropriately formed housing with a plurality of cavities for the bridge contacts. Such a housing with multiple cavities to support the bridge contacts will then also have an identical number of holes at the bottom for pin introduction.

BRIEF DESCRIPTION OF THE DRAWINGS

The invention will now be further elucidated with reference to the drawings showing possible embodiments.

FIGS. 2, 3 and 4 show a front view, a side view and a bottom view, respectively, of an embodiment of the bridge connector of the present invention;

DESCRIPTION OF THE PREFERRED EMBODIMENT

Figure 1:
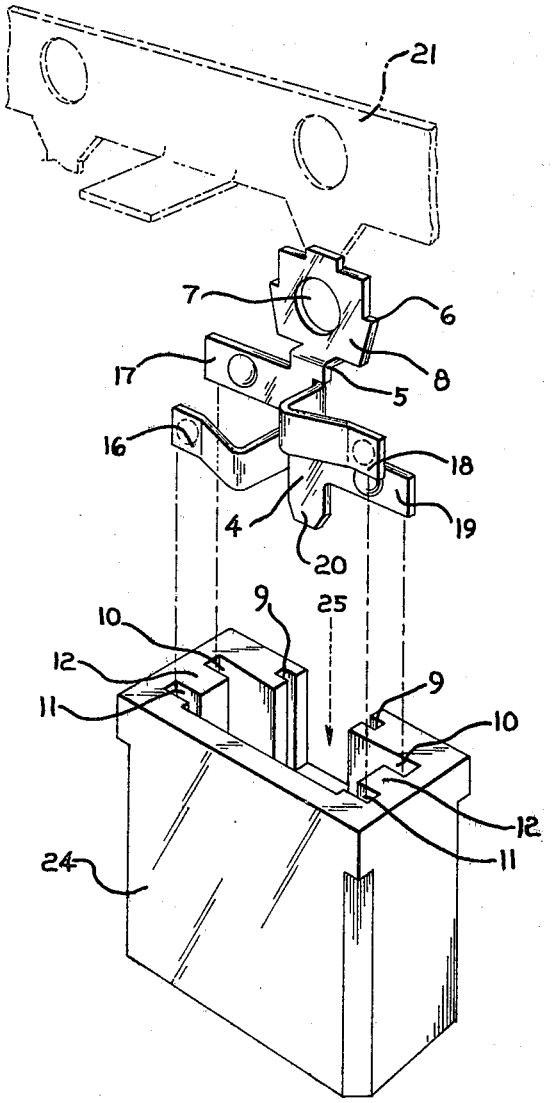
FIG. 1 shows an embodiment of a bridge connector according to the present invention which bridge connector for the sake of clarity is removed from the housing.

The bridge connector terminal, shown in FIG. 1 and more in detail in FIGS. 2, 3 and 4, comprises a central leg 4, positioned vertically in FIG. 1, having at either sides two pairs of branch contacts 16 through 19. These branch contacts are integral with the central leg 4, as well as the broadened portion 8 shown at the top. The bridge connector terminal can be made by punching sheet material, in which it can be suitably bent and, if necessary, provided with a plating layer.

The first pair of branch contacts 17 and 16 extend in FIG. 1 to the left of the central leg 4 and the second pair of branch contacts 18 and 19 extend to the right of this central leg 4. Each pair consists of a branch 17 and 19 respectively, extending in the same plane as the central leg as shown in the bottom view of FIG. 4, together with a bent branch contacts 16 and 18 respectively. These bent branch contacts extend partly in a second plane which is parallel to the plane of the branch contacts 17 and 19 and central leg 4. The bent branch contacts 16 and 18 comprise a first portion 22, starting at the central leg 4 and bent in a direction almost perpendicular to the plane of this central leg. In a second plane these bent branch contacts are rebent again, after which the second portion extends mainly in the same direction as the unbent flat branch contacts 17 and 19, and hence extending towards the second imaginary plane.

Each branch contact is provided towards its ends with contact domes 1 and 2. These contact domes are applied on the sides of the branch contacts 16 and 19. These domes are turned towards each other as shown in FIGS. 3 and 4. The contact domes 1 and 2 may be spherical or cylindrical or any combination thereof depending on the pins used in their application. Such pins may have a cylindrical cross section, an oval cross section or a rectangular cross section. The shape of the contact dome has to be such that a good electrical contact is obtained with the cooperating pin to promote a high specific pressure at the connections. A simultaneous insertion of the pins between the contact domes in the branch contacts should be facilitated. In the figures these contact domes are spherical, a shape generally preferred for connection with pins having a rectangular cross section, i.e., having flat side surfaces. When cylindrical pins are to be used, the contact domes will preferably be also cylindrical in shape. The center line of the cylindrical contact domes may then run parallel to the center line of the cylindrical pins, but may also be perpendicular to the center lines of these pins.

One pin of the printed circuit board, not shown in FIGS. 1 through 4, will be slid between the branch contacts 17 and 16 between the contact domes 2 and 1, respectively, on these branch contacts. The second pin will be slid between the branch contacts 18 and 19, and hence between the contact domes 1 and 2 on these branch contact. As shown in FIGS. 2 and 3, the bent branch contacts 16 and 18 are provided at the bottom with a swagged edge 3 to facilitate the entry of the pins. This swagged edge also facilitates insertion of the bridge connector terminal into the dielectric housing 24.

On top of the branch contacts 17 and 18, FIGS. 1, 2 and 3, the central leg 4 is bent through 90°, so that a neck portion 5 is obtained. This portion is rebent through 90° to obtain a broadened shoulder porton 8. This shoulder portion 8 extends in a plane which is parallel to the plane of the central leg 4 and branch contacts 17 and 19. The shoulder portion 8 comprises a hole 7 and barbs 6 at the edges. This hole 7 is used for facilitating contact with an electrical test probe during circuit testing, but also can be used as an anchor or clamping mechanism during introduction of the bridge connector terminal in the housing 24, or its removal therefrom.

At the bottom side in FIGS. 1, 2 and 3 the central leg 4 is provided with an elongated portion 20. This elongated portion fits in a corresponding cavity 27 provided at the inner bottom of housing 24. In so doing, the bridge contact is firmly anchored after assembly in the housing 24.

Figure 5:
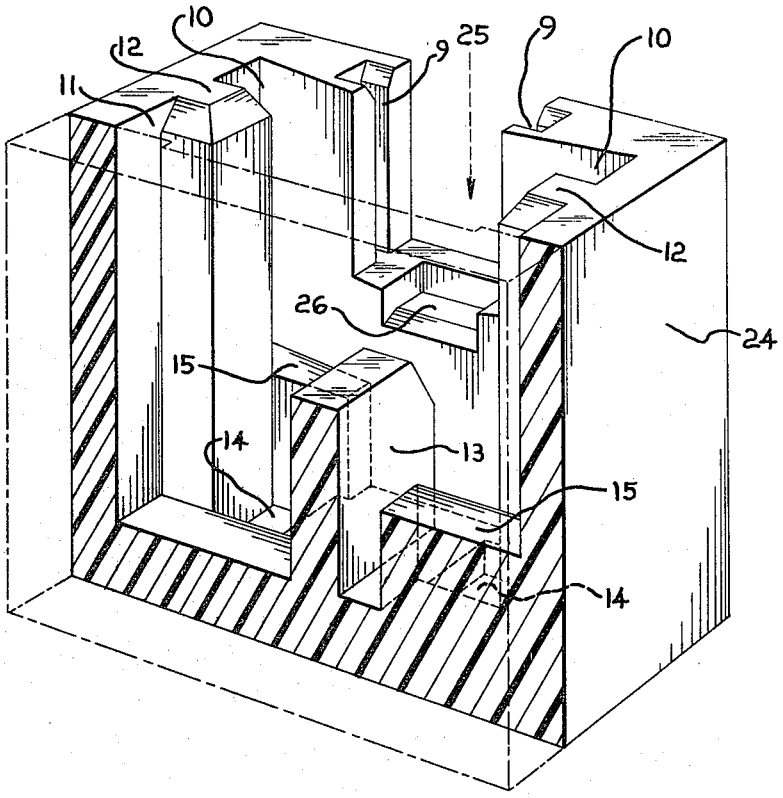
FIG. 5 shows an example of a housing for a bridge connector of the present invention in which for sake of clarity one side wall has been omitted.
Figure 6:
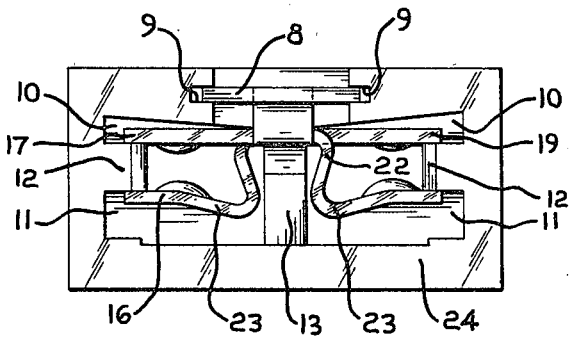
FIGS. 6, 7 and 8 show a top view, a front view and a side view, respectively, of a bridge connector of the present invention, located in the corresponding housing.
Figure 7:
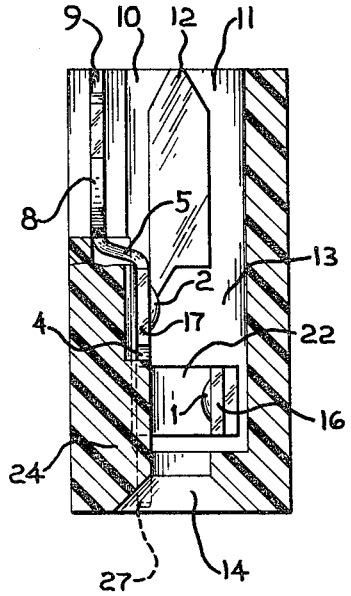
Figure 8:
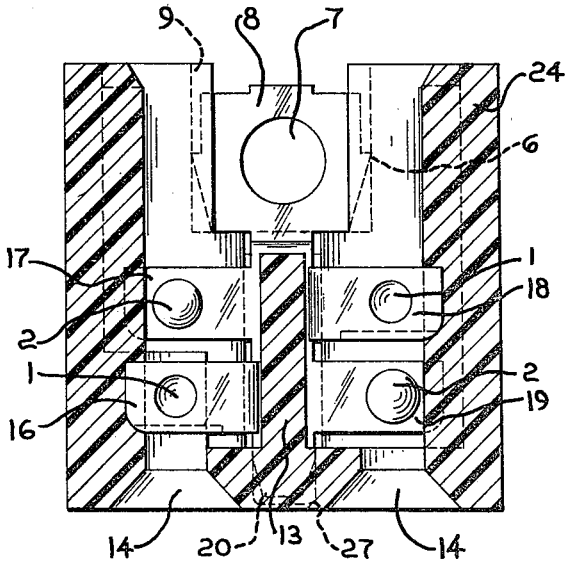

The housing 24 is shown in FIG. 1 and in a more detailed fashion in FIG. 5. FIGS. 6, 7 and 8 show the bridge contact terminal after assembly in the housing.

In FIG. 1 the housing 24 consists of a rectangular hollow box which is open at the top and closed at the bottom with the exception of holes 14, as shown in FIGS. 5, 7 and 8 for pin entry.

The narrow inner side walls of the housing opposite to each other are provided with channels 10 and 11, interposed by a ridge 12. These channels and ridge extend almost to the bottom of the housing. The back wall of the housing 24 is provided with an opening 25 whose parallel vertical side-edge have channels 9. The bottom edge of this opening 25 comprises a step 26, as shown in FIGS. 5 and 8. The front wall of the housing 24 has a ridge 13 which extends from the bottom to almost midway the height of the housing. Also this ridge 13 extends from the front wall towards the rear wall of the housing. Between the ridge 13 and rear wall is a slot, the width of the which corresponds with the thickness of the central leg 4 of the branch connector terminal. Further the front wall as well as the rear wall are provided with ridges 15, extending about halfway the height of ridge 13. Ridges 12 are flush with the side walls of the holes 14 and serve as guiding surface for the pins in the housing 24.

The entry holes 14 are widened to the bottom as shown in FIGS. 7 and 8, which then taper to facilitate the entry of the pins into the housing. Also the housing 24 comprises the said cavity 27 for receiving the elongated portion 20 of the central leg 4.

In FIG. 1, the dotted lines show how the bridge connector terminal can be introduced into the housing 24. During this process, the terminal is lowered until the ends of the bent branch contacts 16 and 18 enter into channels 11 and the ends of the nonbent branch contacts 17 and 18 enter into the channels 10 on either side of ridge 12. See the plan view in FIG. 6. Upon pressing further downwardly the broadened shoulder portion 8 will slide into channels 9 at both sides of the recess 25 in the rear wall. The neck portion 5 of the central leg will then lie in the step recess 26 located at the bottom edge of recess 25 as also shown in FIGS. 5 and 8. Barbs 6 at either side of the shoulder portion 8 dig into the material of enclosure 24. The bridge connector terminal will be thus locked in position within the housing and cannot be removed unintentionally. The central leg 4 will be received in the slot between ridge 13 and the back wall of housing 24, whereas the elongated portion 20 will be received by the cavity 27 in housing 24.

The branch contacts 17, 16 and 18, 19, respectively, are bent towards each other prior to assembly in the housing. During assembly in the housing, ridge 12 moves the branches away from each other. This gives the branch contacts a certain preload.

By combination of barbs 6, the elastic clamp connection of the branch contacts and the friction of the elongated portion 20 in the cavity 27, the bridge contact is immobilized in the housing. Hence, when the pins enter the housing through holes 14, the bridge contact is not pushed out of the enclosure through the opening at the top.

Ridge 13 is useful in centering the bridge connector assembly in the housing 24 and also in preventing possible movement of the bridge connector terminal during termination to the pins.

Excessive movement of the branch contacts 16 through 19 during termination to the pins is limited by the small dimensions of the channels 10 and 11. The above also results in accurate positioning of the housing with respect to the terminated pins. As shown in FIG. 8, the central leg 4 and the nonbent branches 17 and 19 are flush with the inner surface of the back wall of housing 24 and, therefore, are also flush with the edge of the entry holes 14. The same applies to the bent branches 16 and 18 at the opposite side walls of the entry holes 14. This results in a proper pin guidance through the bridge connector. This also prevents the bridge connector assembly and housing from being skewed with respect to the pins and thus prevents overstressing of the branch contacts.

Carrier strip 21 is shown in dotted lines. This strip is used in the fabrication process for the bridge connector terminals. At the lower edge of this strip, a plurality of bridge connector terminals can be formed. Subsequently these are detached from strip 21. However, strip 21 is not necessary for the fabrication of these bridge connectors.

Figure 9:
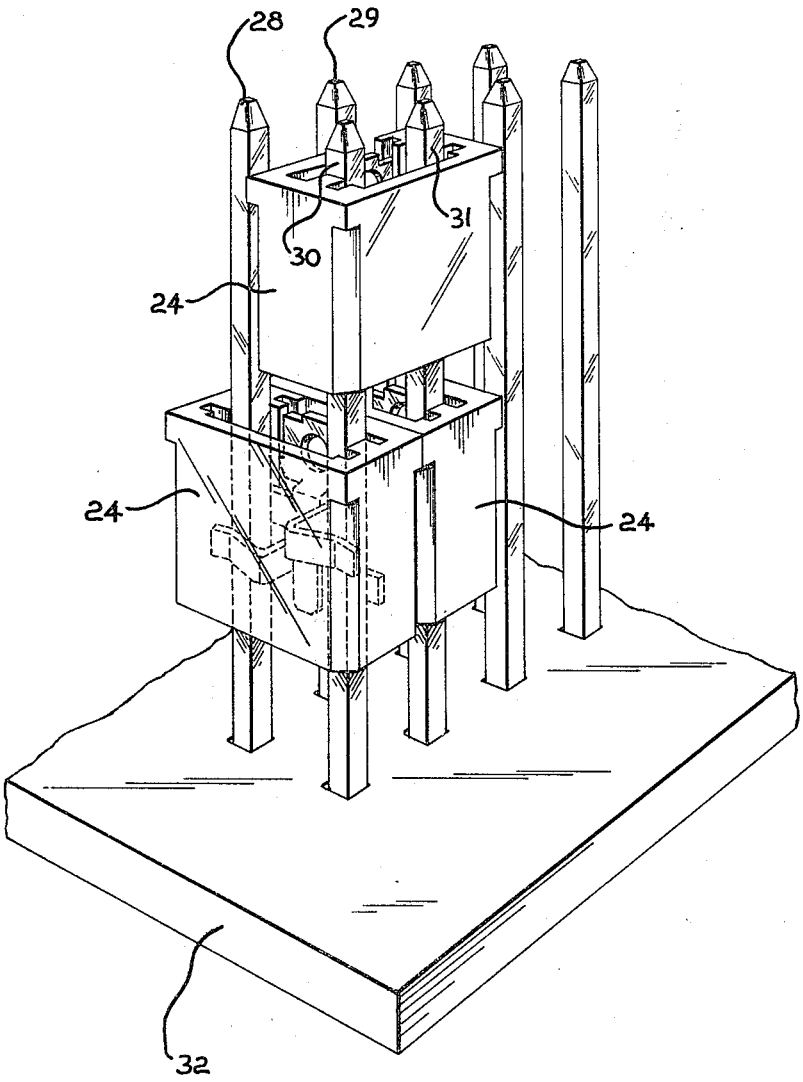
FIG. 9 shows as an example how several bridge connectors of the present invention can be used for connecting pins on a printed circuit board.

FIG. 9 shows the use of the bridge connector of the present invention for short circuiting or connecting pins 28 through 31 of the printed circuit board 32. In FIG. 9 three bridge connectors with housing 24 are terminated on pins 28 through 31, such that these four pins are connected electrically with each other. The left-hand lower bridge connector connects pins 28 and 30, the right-hand lower bridge connector connects pins 29 and 31 and the top bridge connector connects pins 30 and 31. It is shown clearly that the bridge connectors are located in a space between the different pins. The bridge connectors can be pushed further downwardly, so that the pin ends can be used for other bridge connectors or other contact means. Thus each connection pattern programming can be arranged, as desired for a particular application of the circuit on a printed circuit board.

Figure 10:
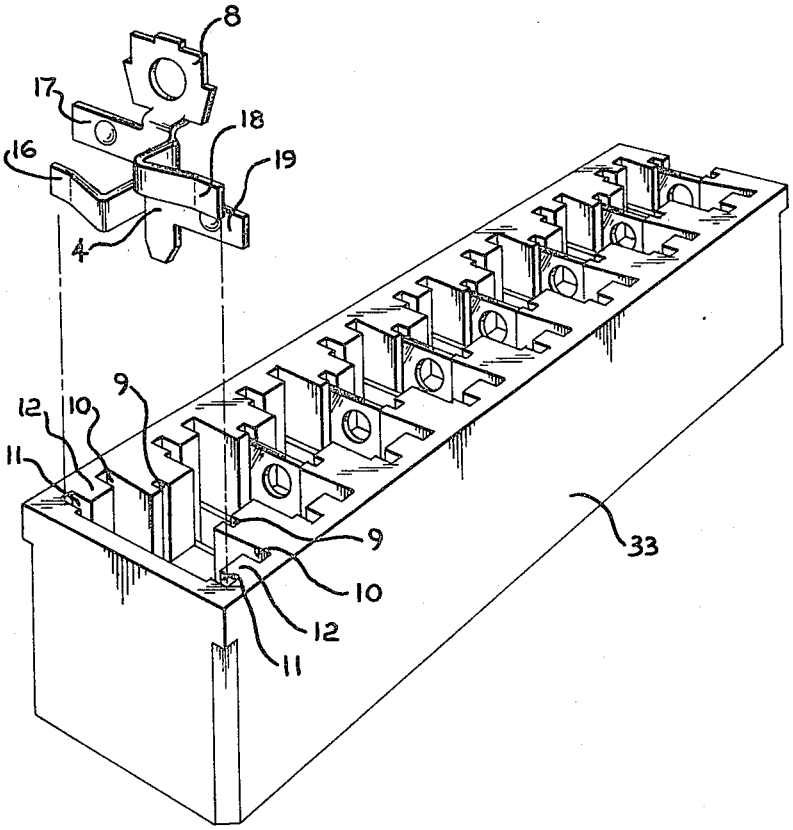
FIG. 10 shows an embodiment of a housing for receiving several bridge connector terminals.

FIG. 10 shows another embodiment of the housing, for receiving a plurality of bridge connector terminals.

The housing 33 comprises a number of cavities in which the same channels and ridges are formed as in the single housing 24 in FIGS. 1 and 2. The bottom of each housing cavity comprises two holes for the pins.

As a matter of course, many electrically conducting bridge connector terminals can be placed in housings such as shown in FIG. 10. Also these bridge connector terminals need not be positioned parallel as shown. Some connectors may be placed transversely and even on top of each other. The housing 33 in FIG. 10 is of the same height as the housing 24 in FIG. 9, so that several housings having a plurality of bridge connector terminals can be stacked in order to obtain a particular connecting pattern for the pins.

The present invention offers a new way for short circuiting or mutually connecting pins on a printed circuit board. This invention is particularly suitable for printed circuit boards with densely packed pins and hardware. The present invention offers the possibility to connect components on this printed circuit board according to varying and differentiating programs. It will be clear, however, that the present invention is not limited to the interconnection of pins on printed circuit boards. However, advantageous use can be made of the space between the pins. In connection herewith, bridge connectors of the present invention generally have very small dimensions. With the usual pin distance a single housing will have a height of for instance maximum 5.08 mm, a width along the smaller side of a maximum of once the pitch of the pins and a width along the larger side of a maximum of twice the pitch of the pins.

It will be clear that the invention is not limited to the shown and above discussed embodiments, and that modifications and adaptions are possible without departing from the scope of the present invention.

I claim:

1. Bridge connector for electrically connecting at least two substantially parallel pins, characterized in that a bridge connector terminal portion consists of a central leg of resilient material, each side having attached at least one pair of branch contacts of the same material, each pair consisting of one substantially straight branch in the same first plane with the central leg and one bent branch having a first portion substantially perpendicular to the central leg and a second portion bent to a position substantially parallel to the straight branch in a second plane with respect to the central leg, each pair of branch contacts having its straight branch at the same level with a bent branch from the corresponding branch contact at the other side of the central leg, the arrangement being such, that upon sliding the bridge connector upon two pins, each pin will be pinched between one end of the mainly straight branch at the one level and laying in the first plane and one end of the second portion of the bent branch at the other level and laying in the second plane, so that the bridge connector terminal partly is loaded torsionally, said bridge connector terminal being located in a dielectric housing open at one end and closed at the other end, said housing containing a pair of parallel channels at each opposite inner surface for receiving the free ends of the branch contacts upon sliding the bridge connector into the open end of the housing, the closed end of the housing being provided with entry holes for said pins.

2. Bridge connector terminal according to claim 1, wherein the central leg comprises an elongation at one end, consisting of a neck portion, bent in a direction extending away from said second plane, and of a shoulder portion being broadened with respect to the central leg, which shoulder portion is rebent from the end of the neck portion into a third plane parallel to the first and second plane, the housing containing two additional opposite channels for receiving the edges of the broadened shoulder portion, said edges running parallel with the central leg.

3. Bridge connector terminal according to claims 1 or 2, wherein the central portion, the branch contacts, the neck portion and the shoulder portion are formed of punched and bent electrically conducting, resilient sheet material.

4. Bridge connector terminal according to claim 1, wherein the side edges of the broadened shoulder portion contain barbs which dig into the housing material, said shoulder portion further comprising a hole for receiving an electrical test probe.

5. Bridge connector according to claim 2, wherein in said housing, channels for receiving the shoulder portion are formed in opposite edges of an open portion of a side wall, the side wall having a ridge interposed between each channel, said side wall being parallel to the planes of said terminal.

6. Bridge connector according to claim 5 wherein the ridge between the channels formed in the opposite inner side walls of the housing and running parallel with the said planes is of such width that the free ends of the branch contacts resiliently rest upon this ridge.

7. Bridge connector according to claim 6 wherein the free ends of the branch contacts comprise contact means at the sides turned to the pins.

8. Bridge connector according to claim 2 wherein the central leg is elongated at the end opposite to the broadened shoulder end and the housing near the closed end comprises a cavity for receiving said elongated end.

9. Bridge connector according to claim 5, wherein the inner side wall of the ridge between the channels for receiving the branch contacts coincides with a side wall of the holes for entry of the pins in the housing closed end, so that the pins will rest upon the side wall of the ridge.

10. Bridge connector according to claim 1 wherein said housing comprises a plurality of cavities, each cavity comprising means for receiving and supporting a separate bridge connector terminal and holes in the bottom of each cavity for the entry of pins.

* * * * *